US010051389B2

(12) United States Patent
Baeriswyl et al.

(10) Patent No.: US 10,051,389 B2
(45) Date of Patent: Aug. 14, 2018

(54) HEARING DEVICE COMPRISING AN ELECTRIC CABLE

(71) Applicant: BERNAFON AG, Berne (CH)

(72) Inventors: Bernhard Baeriswyl, Berne (CH); Fabian Morant, Berne (CH); Eric Spahr, Berne (CH)

(73) Assignee: BERNAFON AG, Berne (CH)

( * ) Notice: Subject to any disclaimer, the term of this patent is extended or adjusted under 35 U.S.C. 154(b) by 0 days.

(21) Appl. No.: 15/277,060

(22) Filed: Sep. 27, 2016

(65) Prior Publication Data

US 2017/0094425 A1 Mar. 30, 2017

(30) Foreign Application Priority Data

Sep. 28, 2015 (EP) ..... 15187140

(51) Int. Cl.
*H04R 25/00* (2006.01)
*H04R 1/10* (2006.01)

(52) U.S. Cl.
CPC ..... *H04R 25/556* (2013.01); *H04R 1/1066* (2013.01); *H04R 25/604* (2013.01); *H04R 2225/61* (2013.01)

(58) Field of Classification Search
CPC ..... H04R 1/1033; H04R 25/556; H01R 35/02
See application file for complete search history.

(56) References Cited

U.S. PATENT DOCUMENTS 4,137,431 A * 1/1979 Pallesen ..... H04R 25/556 381/327
4,579,403 A * 4/1986 Byrne ..... H01R 35/02 439/33
7,027,608 B2 * 4/2006 Fretz ..... H04R 25/65 381/322
7,110,562 B1 * 9/2006 Feeley ..... H04R 25/60 381/322
7,946,890 B1 * 5/2011 Bondo ..... H01R 31/005 439/638
8,348,684 B2 * 1/2013 Ladouceur ..... G06F 1/1656 439/131
8,385,573 B2 * 2/2013 Higgins ..... H01R 13/2414 381/322
9,270,068 B2 * 2/2016 Liang ..... H01R 35/02
2006/0159298 A1 * 7/2006 von Dombrowski .. H04R 25/48 381/330
2011/0194717 A1 * 8/2011 Hansen ..... H01Q 1/273 381/328
2012/0014549 A1 1/2012 Higgins et al.
(Continued)

FOREIGN PATENT DOCUMENTS

WO WO 2013/123992 A1 8/2013

*Primary Examiner* — Curtis Kuntz
*Assistant Examiner* — Ryan Robinson
(74) *Attorney, Agent, or Firm* — Birch, Stewart, Kolasch & Birch, LLP

(57) ABSTRACT

A hearing device is disclosed. The hearing device comprises a receiver and/or a microphone unit and a first connector (e.g. a socket) for establishing an electric connection between one or more components of the hearing device and the receiver and/or microphone unit, wherein the receiver and/or microphone unit comprises second connector (e.g. a plug member) configured to be received by the first connector. The first connector is movably mounted in the hearing device.

19 Claims, 4 Drawing Sheets

(56) References Cited

U.S. PATENT DOCUMENTS

| | | | | |
|---|---|---|---|---|
| 2012/0328139 | A1 | 12/2012 | Naumann et al. | |
| 2014/0233783 | A1 | 8/2014 | Chardon et al. | |
| 2016/0183018 | A1* | 6/2016 | Spearman | H04R 25/65 381/324 |
| 2016/0249142 | A1* | 8/2016 | Beyfuss | G10K 11/22 |
| 2017/0013374 | A1* | 1/2017 | Larsen | H04R 25/604 |

* cited by examiner

HEARING DEVICE COMPRISING AN ELECTRIC CABLE

FIELD

The present disclosure relates to a hearing device. More particularly, the disclosure relates to a hearing device provided with an electric cable arranged in a manner in which the length of the electric cable can be varied without cutting the electric cable.

BACKGROUND

Receiver-In-The-Ear (RITE) type hearing devices are widely used and popular. In RITE type hearing devices, a receiver is arranged at or inside the ear canal. Accordingly, the RITE type hearing devices can be made smaller than Behind-The-Ear (BTE) devices. In the present application the term 'receiver' is intended to cover 'a loudspeaker' and the two terms are used interchangeably without any intentional difference in meaning.

A RITE-type hearing device comprises a BTE-part adapted for being located behind an ear of a user and an ITE-part (comprising the receiver/loudspeaker) adapted to be located at or in an ear canal of the user. The two parts are connected by a cable comprising electrical conductors for electrically connecting electronic components of the BTE-part with electronic components of the ITE-part (including the receiver/loudspeaker).

An optimal location of the housing of the hearing device and the receiver of different persons or ears typically requires different lengths of the electrical cable extending between the hearing device housing and the receiver. Therefore, in the prior art solutions, the length of the electric cable needs to be individually adjusted.

SUMMARY

Therefore, it would be desirable to have a hearing device in which the electric cable could be arranged in a manner in which the length of the electric cable can be varied in order to meet individual requirements without cutting the electric cable.

According to an aspect of the disclosure, the hearing device comprises a receiver and/or a microphone unit and a first connector (e.g. a socket) for establishing an electric connection between one or more components of the hearing device and the receiver and/or microphone unit, wherein the receiver and/or microphone unit comprises a second connector (e.g. a plug member) configured to be electrically connected to the first connector (e.g. received by the socket), wherein the first connector (e.g. the socket) is movably mounted in the hearing device.

Hereby, an optimal length of the electric cable can be achieved without cutting the electric cable. Accordingly, the hearing device can be delivered with one standard length of the electric cable and the length of the electric cable can be individually adjusted and used for all individuals. The length of the electric cable can be adjusted to fit hearing devices to left as well as right ears and to different persons. The length adjustment can be achieved by changing the position of the movable first connector (e.g. a socket).

In an embodiment, the first connector is a socket type connector and the second connector is a plug type connector. In an embodiment, the first connector is a plug type connector and the second connector is a socket type connector. Each of the first and second connectors can be implemented as a plug type or a socket type connector (e.g. according to the particular design), as long as the pair of first and second connectors are mating connectors. In the following, it is intended that when a particular type of connector is mentioned as the first connector (e.g. a socket), this should also include the use of the 'opposite' (mating) connector (here, a plug) provided that the second connector is also changed to the 'opposite' (mating) connector.

In an embodiment, the hearing device is of the RITE-type hearing device comprising a BTE-part adapted for being located behind an ear of a user and an ITE-part (comprising the receiver/loudspeaker and/or optionally a microphone) adapted to be located at or in an ear canal of the user. The two parts are connected by a cable comprising electrical conductors (and e.g. a plug member or a socket) for electrically connecting electronic components of the BTE-part with electronic components of the ITE-part (including the receiver/loudspeaker and/or microphone).

In an embodiment, the hearing device (e.g. a BTE-part of the hearing device) comprises a receiver and/or a microphone unit and a socket for establishing an electric connection between one or more components of the hearing device and the receiver and/or a microphone unit. The socket may be configured to establish electric connection between the housing of the hearing device and the receiver and/or microphone unit. Alternatively, the BTE-part of the hearing device may comprises a plug member for the same purpose.

The receiver and/or microphone unit comprises a plug member configured to be received by the socket, wherein the socket is movably mounted in the hearing device. The socket may be slidably mounted to the housing of the hearing device or to a structure attached to the housing.

In one embodiment according to the disclosure, the plug member is electrically connected to the receiver and/or microphone unit via an electric cable.

Hereby, the electric cable establishes electrical contact with the receiver and/or microphone unit. Accordingly, electrical signals can be sent to the receiver or received from the microphone unit via an electric cable.

In another embodiment according to the disclosure, the hearing device comprises a housing having an inner space, wherein the socket is slidably arranged in the inner space.

Hereby, the length of the electric cable can be adjusted by varying the portion of the electric cable in the housing by moving the socket within the inner space.

In a further embodiment according to the disclosure, the receiver and/or microphone unit comprises a plug member comprising an insertion member configured to be engagingly inserted into a corresponding receiving structure in the socket.

Hereby, it is possible to achieve an easy engagement between the plug member and the socket.

It may be preferred that the one or more electrical connections between the plug member and the socket are established when the plug member and the socket are connected by engagingly inserting the insertion member into the corresponding receiving structure in the socket.

In another embodiment according to the disclosure, the socket is configured to be positioned in a position in the hearing device, in which position the socket is not visible from outside.

In an even further embodiment according to the disclosure, the socket is electrically connected to a flexible wire or Litz wire arranged in the inner space of the housing.

Hereby, it is possible to establish an electrical connection to the electric cable through the flexible wire or Litz wire arranged in the inner space of the housing. The flexible wire or Litz wire arranged in the inner space of the housing can preferably be connected to a signal processing unit for processing an input audio signal and/or an output unit for providing an audible signal to the user in dependence on the processed audio signal.

Embodiments of the present disclosure enable that an initially flexible cable can be adapted (in length and form) to an individual's ear anatomy while still bendable. Once the right geometry of the cable is found, its shape is "frozen" so that the final cable is no longer flexible but rigid.

In an embodiment according to the disclosure, the electric cable is in a flexible state and where at least a portion of the electric cable is configured to be hardened (to for a rigid portion of the cable) by means of heat or light, preferably by means of ultraviolet (UV) light (e.g. after having been adapted to a specific user).

Hereby, it is possible to adjust the length of the electric cable and harden the electric cable by means of heat or light when the adjustment is complete. When the electric cable has hardened, the length of the electric cable can no longer be changed.

In yet a further embodiment according to the disclosure, the electric cable is in a flexible state and at least a portion of the electric cable is configured to be hardened by means of a chemical reaction initiated when at least two compounds in the electric cable are mixed, preferably upon bending of the electric cable or rupture of an inner structure in the electric cable.

Hereby, it is possible to adjust the length of the electric cable and harden the electric cable by means of a chemical reaction initiated when at least two compounds in the electric cable are mixed, when the adjustment is complete. When the electric cable has hardened, the length of the electric cable can no longer be changed.

In yet a further embodiment according to the disclosure, the portion of the electric cable that is configured to be hardened, is configured to keep its geometrical shape when hardened.

Hereby, it is possible to achieve a preferred permanent geometrical shape.

In another embodiment according to the disclosure, the housing comprises a cover movably attached to the housing. Hereby, it is possible to move the cover in order to have access to the inner portion of the housing in order to adjust the length of the electric cable by changing the position of the movable socket.

In a further embodiment according to the disclosure, the cover is rotatably or pivotably attached to the housing by means of a joint structure.

A cover that is rotatably or pivotably attached to the housing by means of a joint structure provides an easy, user-friendly and robust opening structure.

In another embodiment according to the disclosure, the housing comprises a receiving member and wherein the cover comprises an attachment member attached to the cover, wherein the attachment member is configured to be received by the receiving member, preferably engagely received by the receiving member.

Hereby, the cover can be securely closed and fixed to the housing of the hearing device.

In a preferred embodiment according to the disclosure, the cover is adapted to be opened to such an extent that there is access to the socket from the outside the housing in order to move the socket.

Accordingly, it is possible to adjust the length of the electric cable by changing the position of the movable socket.

In one embodiment according to the disclosure, the method is a method for adjusting the length and/or shape of an electric cable protruding from a hearing device comprising a receiver and/or a microphone unit and a connector (e.g. a socket), wherein the electric cable is connected to the receiver and/or a microphone unit, wherein the method comprises the step of:

a) establishing an electrical connection between the receiver and/or microphone unit and the connector (e.g. a socket);

b) moving the connector (e.g. a socket) and hereby changing the position of the connector (e.g. a socket) in the hearing device in order to adjust the length and/or shape of the electric cable.

Hereby, an optimal length of the electric cable can be achieved without cutting the electric cable by using the method. Accordingly, the hearing device can be delivered with one standard length of the electric cable, and the length of the electric cable can be individually adjusted and used for all individuals. The length of the electric cable can be adjusted to fit hearing devices to left as well as right ears and to different persons. The length adjustment can be achieved by changing the position of the movable socket.

In a further embodiment according to the disclosure, the method is a method for adjusting the length and/or shape of an electric cable protruding from a hearing device comprising a housing and a plug member connected to the proximal end of the electric cable, wherein the hearing device comprises a socket movably mounted in the housing of the hearing device, wherein the method comprises the step of:

a) plugging the plug member of the receiver and/or the microphone unit into the socket;

b) moving the socket and hereby changing the position of the socket in the hearing device in order to adjust the length and/or shape of the electric cable.

Hereby, an electrical connection is established between the plug member of the receiver and/or the microphone unit into the socket and an optimum length of the electric cable can be achieved.

In an even further embodiment according to the disclosure, the hearing device comprises a cover movably attached to the housing, wherein the method comprises the step of:

a) opening the cover;

b) moving the socket and hereby changing the position of the socket;

c) closing the cover.

Hereby, the length of the electric cable can be changed in a manner that is not visible from outside the housing.

In another embodiment according to the disclosure, the method comprises the step of:

a) hardening at least a portion of the electric cable by means of heat or light, preferably by means of UV light.

Hereby, a permanent geometric shape of the electric cable can be achieved in an easy manner.

In a further embodiment according to the disclosure, the method comprises the step of:

a) hardening at least a portion of the electric cable by means of a chemical reaction initiated by mixing at least two compounds in the electric cable.

Hereby, a permanent geometric shape of the electric cable can be achieved in an alternative manner.

In another embodiment according to the disclosure, the mixing of at least two compounds in the electric cable is achieved by bending the electric cable or providing a rupture of an inner structure in the electric cable.

In a further embodiment according to the disclosure, the electric cable comprises a number of separate (mutually electrically insulated) electric conductors.

In one embodiment according to the disclosure, the electric cable comprises two, three or more separate (mutually electrically insulated) electric conductors.

Hereby, the electric cable is capable of providing several electric connections between the receiver and/or microphone unit and one or more components (e.g. a signal processing unit for processing an input audio signal and/or an output unit for providing an audible signal to the user in dependence on the processed audio signal) in the housing.

In a further embodiment according to the disclosure, the hearing device comprises a behind-the-ear part adapted for being located at or behind an ear of a user, and an in-the-ear part adapted for being located at or in an ear canal of the user.

The behind-the-ear part may preferably be electrically connected to the in-the-ear part by the electric cable.

In another embodiment according to the disclosure, the in-the-ear part comprises the receiver and/or microphone unit.

An optimal location of the behind-the-ear part and the in-the-ear part at the ear(s) of different persons (or ears) typically requires different lengths of cable. The present solution has the advantage that a single length of electric cable can be used for fitting the hearing device to left as well as right ears of a person and to different persons, because possible needs for different lengths can be accommodated by adjustment of the movable socket.

In a further embodiment according to the disclosure, the hearing device is configured to allow a displacement of the movable socket that is adapted to the difference in length between an expected needed minimum length and an expected needed maximum length of the electric cable (to be able to optimally fit the location of the behind-the-ear parts and the in-the-ear parts of at least a multitude of persons, using the same length of cable.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effects will be apparent from and elucidated with reference to the illustrations described hereinafter in which:

DETAILED DESCRIPTION

Figure 1:
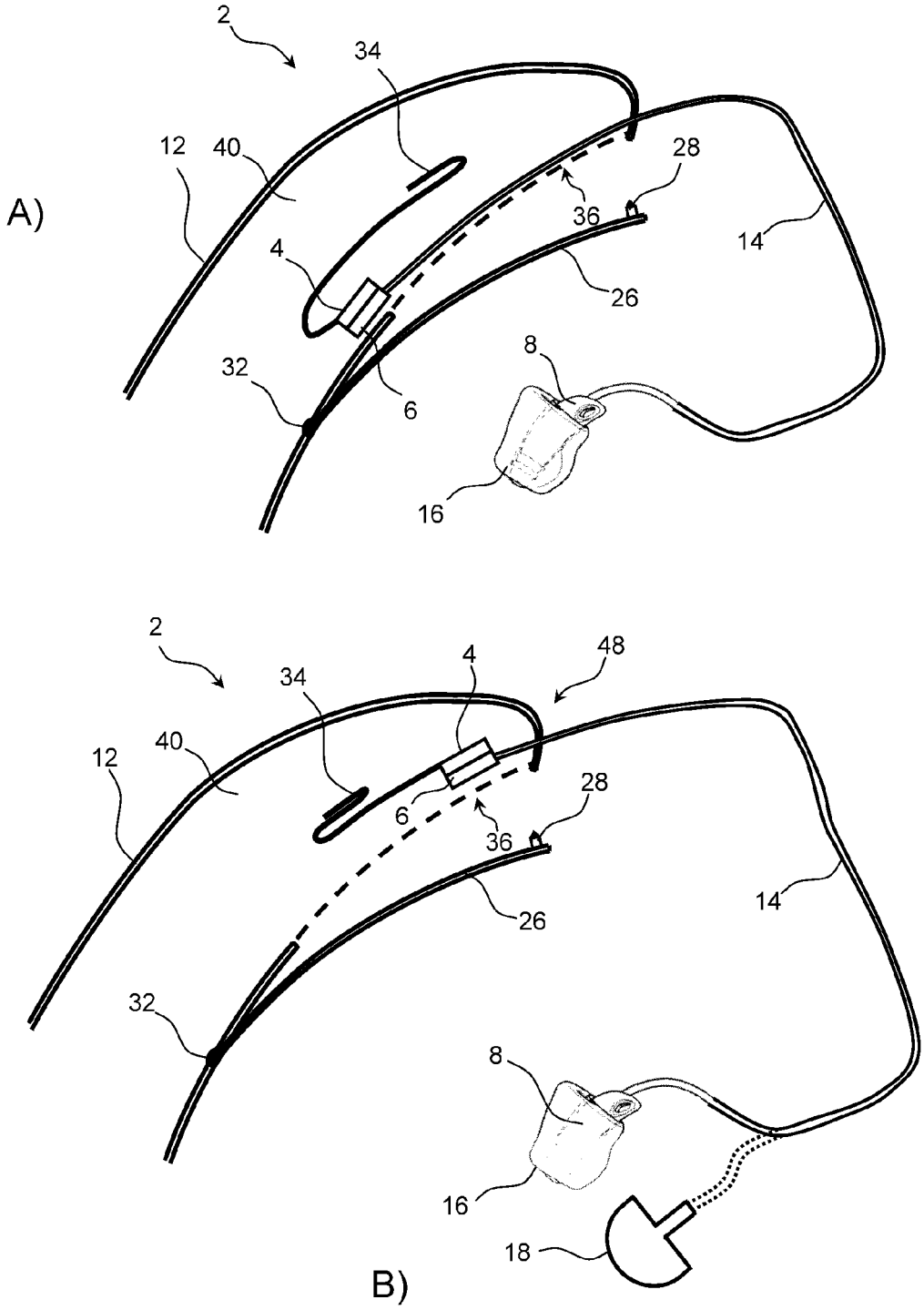
FIG. 1A shows a schematic view of a hearing device according to an embodiment of the disclosure in a first configuration.
FIG. 1B shows a schematic view of the hearing device shown in FIG. 1A in another configuration, in which the length of the electric cable is increased.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon the particular application, design constraints or other reasons, these elements may be implemented using electronic hardware, computer programs, or any combination thereof.

The printed circuit board may comprise any suitable electronic hardware, including microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signal as an audible signal to at least one of the user's ears. Such audible signals may be provided in the form of an acoustic signal radiated into the user's outer ear, or an acoustic signal transferred as mechanical vibrations to the user's inner ear through bone structure of the user's head and/or through parts of the middle ear of the user or electric signals transferred directly or indirectly to the cochlear nerve and/or to the auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in a Bone Anchored Hearing Aid or a Cochlear Implant.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include an auxiliary device(s) that communicates with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of the following: remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, or a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or in another electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such a directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Now referring to FIG. 1A which illustrates a schematic view of a hearing device 2 according to an embodiment of the disclosure. The hearing device 2 comprises a housing 12 and a cover 26 rotatably attached to the housing 12 by means of a joint member 32. The cover 26 comprises an attachment member 28 adapted to be received by a corresponding receiving member (see FIG. 2). The hearing device 2 further comprises a receiver 8 arranged in an ear mould 16. The receiver 8 is electrically connected to an electric cable 14 that is electrically connected to a plug member 6 arranged in the inner space 40 of the housing 12. The plug member 6 is mechanically attached to and electrically connected to a socket 4 that is electrically connected to a wire 34 (a flexible wire or a Litz wire).

Even though not illustrated, the wire 34 is connected to a signal processing unit for processing an input audio signal and/or an output unit for providing an audible signal to the user in dependence on the processed audio signal.

Since the cover 26 is opened, an opening 36 is provided in the housing 12. When the cover 12 is closed, the cover 12 will be arranged to extend along the dotted line indicated on FIG. 1A.

FIG. 1B illustrates a schematic view of the hearing device 2 shown in FIG. 1A in another configuration, in which the length of the electric cable 14 has been increased by moving the socket 4 and plug member 6 attached thereto.

The configuration of the housing 12 and the cover is similar to the one shown in FIG. 1A, however, the socket 4 and plug member 6 have been displaced towards the top portion 48 of the housing 12. Accordingly, the length of the electric cable 14 has been increased in order to allow the receiver and ear mould 16 into which the receiver is arranged to be positioned in a longer distance from the hearing device 2. With a dotted line, it is indicated that the ear mould 16 may be replaced by a dome 18.

Figure 2:
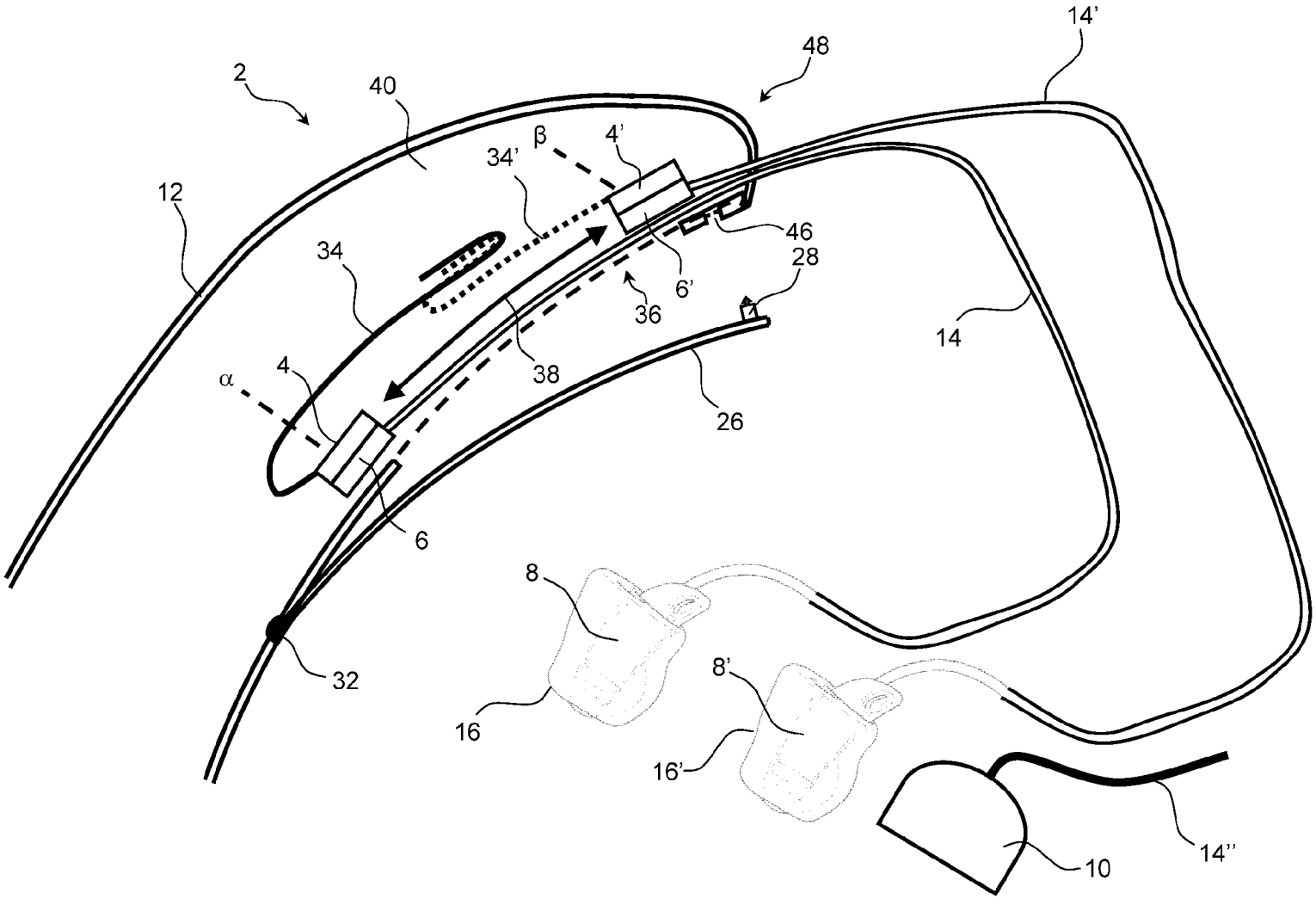
FIG. 2 shows another schematic view of a hearing device according to an embodiment of the disclosure.

FIG. 2 illustrates another schematic view of a hearing device 2 according to an embodiment of the disclosure. The hearing device 2 comprises a housing 12 having a top portion 48, an inner space 40 and an opening 36. For illustration purposes, the battery, the amplifier components, the microphone, the signal processing unit, control unit and the battery are not shown.

The housing 12 comprises a cover 26 rotatably attached thereto. In the distal portion of the cover 26, an attachment member 28 is provided. The attachment member 28 is configured to be engagely received by a corresponding receiving member 46 provided in the housing 12 near the top portion 48 of the housing 12.

As indicated by arrow 38, the socket 4 and plug member 6 attached thereto can be moved between a first position $\alpha$ and a second position $\beta$. When the socket 4 and plug member 6 are positioned at the first position $\alpha$, the electric cable 14 is arranged in a first configuration allowing the receiver 8 and the ear mould 16 attached thereto to be inserted into a first depth (defined by the length of the electric cable 14) of the ear canal of the user.

When the socket 4 and plug member 6 are positioned at the second position $\beta$, the electric cable 14 is arranged in a second configuration allowing the receiver 8' and the ear mould 16' attached thereto to be inserted into a second depth (defined by the length of the electric cable 14') of the ear canal of the user.

Hereby, it is possible to adjust the length of the electric cable 14, 14' in order to provide the receiver 8, 8' in the optimum position in the ear canal of the user.

The socket 4 is attached to a wire 34, 34' that may be a flexible wire or a Litz wire. In the first position, the wire 34 is indicated with a solid line, whereas in the second position the wire 34' is indicated with a dotted line.

As indicated, the ear mould 16, 16' may be replaced by a microphone unit 10 electrically connected to an electric cable 14". In a further embodiment, a microphone may be included in ear mould 16, 16' or similar construction (i.e. in the ITE-part of the hearing aid), e.g. to allow the microphone be located at the entrance of the ear canal facing the environment or in the residual volume facing the eardrum.

Figure 3B:
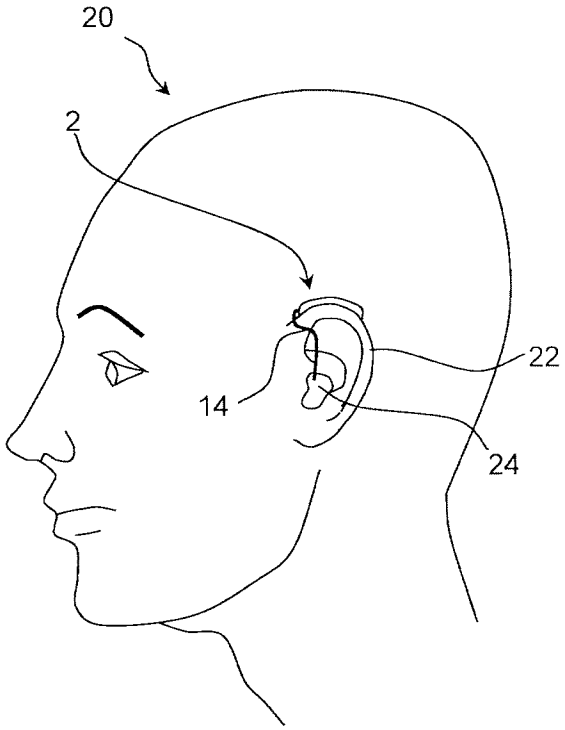
FIG. 3B shows a side view of the hearing device user shown in FIG. 3A
Figure 3A:
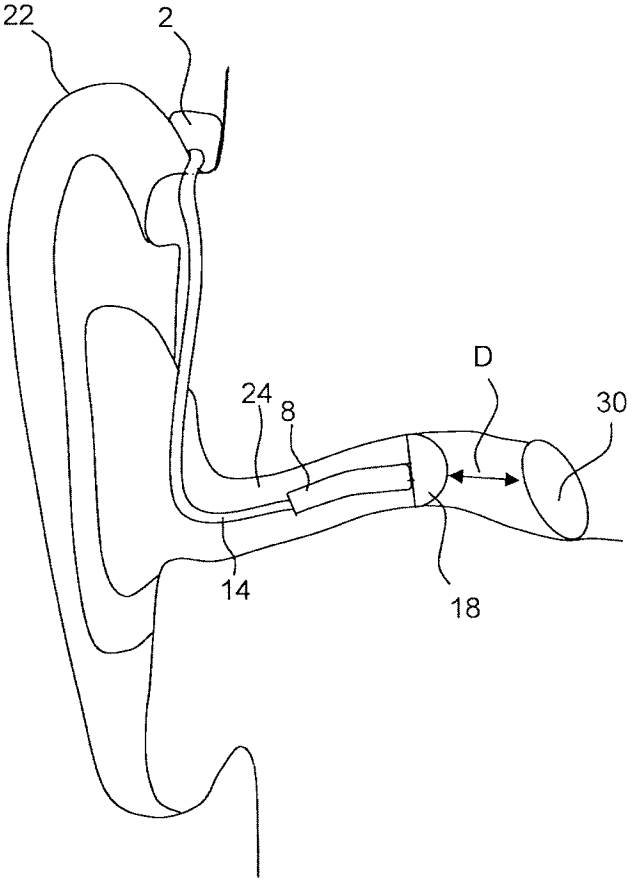
FIG. 3A shows a hearing device according to an embodiment of the disclosure arranged attached on a hearing device user.

FIG. 3A and FIG. 3B illustrate a hearing device 2 according to an embodiment of the disclosure arranged to be attached on a hearing device user 20.

FIG. 3A illustrates a cross-sectional view of the ear canal 24 of the hearing device user. The hearing device 2 is a RITE type hearing device comprising a behind-the-ear part (housing) that is placed behind the ear 22 of the user. An electric cable 14 extends from the behind-the-ear part (housing) of the hearing device 2 through the ear canal 24 to a receiver 8 that is received by a dome 18 arranged in the optimum distance D from the ear drum 30.

FIG. 3B illustrates a side view of the user 20. It can be seen that the hearing device 2 is a RITE type hearing device comprising a behind-the-ear part (housing placed behind the ear 22 of the user) like shown in FIG. 3A. An electric cable 14 electrically connects the behind-the-ear part (housing) of the hearing device 2 and the receiver arranged in the ear canal 24 of the user 20.

While the optimum length of the electric cable 14 is being found, the electric cable is in a flexible state. When the optimum length has been selected at least a portion of the electric cable 14 can be hardened either by means of heat or light (e.g. UV light) or by means of a chemical reaction initiated when at least two compounds in the electric cable 14 are mixed, preferably upon bending of the electric cable or rupture of an inner structure in the electric cable 14.

Accordingly, it is possible to adjust the length of the electric cable 14 and harden the electric cable 14 once the optimum length has been found. When the electric cable 14 has hardened, the length of the electric cable 14 can no longer be changed.

Figure 4:
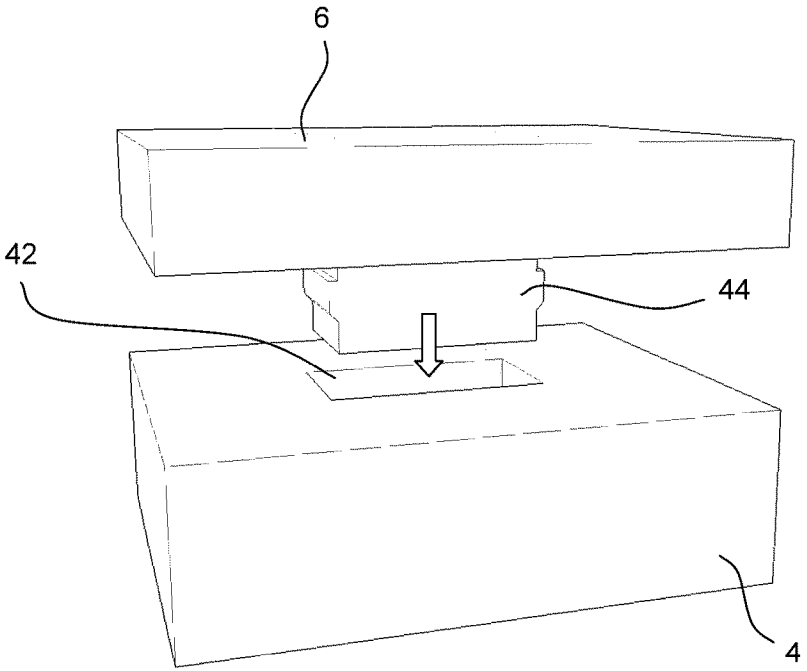
FIG. 4 shows a schematic perspective view of a socket and a plug member being attached to one another.

FIG. 4 illustrates a schematic perspective view of a socket 4 and a plug member 6 being attached to one another. The plug 6 comprises a basically box-shaped body portion and an insertion member 44 protruding therefrom. The insertion member 44 is configured to be engagely received by a corresponding receiving structure 42 provided in a socket 4.

The insertion member 44 is adapted to establish electrical convection between one or more electrical connections between the plug member 6 and the socket 4 by engagingly inserting the insertion member 44 into the corresponding receiving structure 42 in the socket 4.

It is, however, possible to have a plug member that comprises a basically box-shaped body portion and an insertion member protruding therefrom, wherein the insertion member is adapted to be engagely received by a corresponding receiving structure provided in the socket. In this embodiment according to the disclosure, it would be possible to have an insertion member configured to establish electrical connection between one or more electrical connections between the plug member and the socket by engagingly inserting the insertion member into the corresponding receiving structure in the socket.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

LIST OF REFERENCE NUMERALS

2 Hearing device
4, 4' Socket
6, 6' Plug member
8, 8' Receiver
10 Microphone unit
12 Housing
14, 14', 14" Electric cable
16, 16' Ear mould
18 Dome
20 Hearing device user
22 Ear
24 Ear canal
26 Cover
28 Attachment member
30 Ear drum
32 Joint member
34 Flexible wire or Litz wire
36 Opening
38 Arrow
40 Inner space
42 Receiving structure
44 Insertion member
46 Receiving member
48 Top portion
D Distance
α First position
β Second position

The invention claimed is:

1. A hearing device comprising:
a behind-the-ear (BTE) unit; and
an in-the-ear (ITE) unit, said ITE unit comprising at least one of a receiver and a microphone, wherein said BTE unit includes a first connector for establishing an electric connection between the BTE unit and the ITE unit, wherein the ITE unit comprises an electric cable and a second connector configured to be received by the first connector, wherein the first connector is movably mounted in the BTE unit, thereby facilitating a length adjustment of the portion of the electric cable that is external to the BTE unit when the second connector is received by the first connector, and wherein the first connector is slidably arranged in the BTE unit.

2. A hearing device according to claim 1, wherein the second connector is electrically connected to the at least one of the receiver and the microphone via the electric cable.

3. A hearing device according to claim 1, wherein the BTE unit comprises a housing having an inner space, wherein the first connector is slidably arranged in the inner space.

4. A hearing device according to claim 1, wherein the second connector of the ITE unit comprises a plug member comprising an insertion member configured to be engagingly inserted into a corresponding receiving structure in the first connector.

5. A hearing device according to claim 3, wherein the first connector is electrically connected to a flexible wire or Litz wire arranged in the inner space of the housing.

6. A hearing device according to claim 1, wherein the electric cable is in a flexible state prior to the length adjustment and where, after the length adjustment, at least a portion of the electric cable is hardened by means of heat or light.

7. A hearing device according to claim 1, wherein the electric cable is in a flexible state prior to the length adjustment and where, after the length adjustment, at least a portion of the length of electric cable is hardened by means of a chemical reaction initiated when at least two compounds in the electric cable are mixed.

8. A hearing device according to claim 3, wherein the housing comprises a cover movably attached to the housing.

9. A hearing device according to claim 8, wherein the housing comprises a receiving member and wherein the cover comprises an attachment member attached to the cover, wherein the attachment member is configured to be received by the receiving member.

10. A hearing device according to claim 8, wherein the cover is adapted to be opened to such an extent that there is access to the first connector from the outside the housing in order to move the first connector.

11. A hearing device according to claim 2, wherein the BTE unit is adapted for being located behind an ear of a user and the ITE unit is adapted to be located at or in an ear canal of the user, wherein the BTE unit and the ITE unit are connected by said electric cable comprising electrical conductors and said second connector for electrically connecting electronic components of the BTE unit with electronic components of the ITE unit including the at least one of the receiver and the microphone.

12. A hearing device according to claim 1 comprising a hearing aid that is adapted to improve or augment the hearing capability of a user by receiving an acoustic signal from a user's surroundings, generating a corresponding audio signal, and providing the audio signal as an audible signal to at least one of the user's ears.

13. A hearing device according to claim 1, wherein the first connector is a socket type connector and the second connector is a plug type connector.

14. A hearing device according to claim 1, wherein the first connector is a plug type connector and the second connector is a socket type connector.

15. Method for adjusting the length of an electric cable protruding from a behind-the-ear (BTE) unit of a hearing device to an in-the-ear (ITE) unit of the hearing device, the ITE unit comprising at least one of a receiver and a microphone, the BTE unit comprising a connector movably mounted therein, wherein the electric cable is connected to the ITE unit, wherein the method comprises the steps of:

establishing an electrical connection between the ITE unit and the connector via the electric cable;

moving the connector within the BTE unit and hereby changing the position of the connector in the BTE unit in order to adjust the length of the portion of the electric cable external to the BTE unit when the electrical connection between the ITE unit and the connector is established via the electric cable, and wherein the connector is slidably arranged in the BTE unit.

16. Method according to claim 15, wherein a plug member is connected to the proximal end of the electric cable, wherein the BTE unit comprises a housing and a socket movably mounted in the housing, wherein the method further comprises the steps of:

plugging the plug member into the socket;

moving the socket and hereby changing the position of the socket in the BTE unit in order to adjust the length of the portion of the electric cable external to the BTE unit.

17. Method according to claim 15, wherein the BTE unit comprises a housing and a cover movably attached to the housing, wherein the method further comprises the steps of:

opening the cover;

moving the connector and hereby changing the position of the connector;

closing the cover.

18. Method according to claim 17, wherein the method further comprises the step of:

hardening at least a portion of the electric cable by means of heat or light.

19. Method according to claim 17, wherein the method further comprises the step of:

hardening at least a portion of the electric cable by means of a chemical reaction initiated by mixing at least two compounds in the electric cable.

* * * * *